United States Patent [19]

Sutcliffe et al.

[11] 4,031,930

[45] June 28, 1977

[54] AUTOMATIC SHUT-OFF NOZZLE WITH LOCKABLE VAPOR RELIEF VALVE

[75] Inventors: Grenville G. Sutcliffe, Ville Ridge; Janis Dumpis, St. Ann, both of Mo.

[73] Assignee: Husky Corporation, Pacific, Mo.

[22] Filed: Feb. 9, 1976

[21] Appl. No.: 656,433

[52] U.S. Cl. ..... 141/207; 141/208; 141/226

[51] Int. Cl.[2] ..... B65B 3/18; B65B 57/14

[58] Field of Search ..... 141/1, 59, 128, 206–229, 141/198, 290, 301, 302, 346, 347, 351–355, 392

[56] References Cited

UNITED STATES PATENTS

| | | | |
|---|---|---|---|
| 3,521,679 | 7/1970 | Copony | 141/208 |
| 3,605,824 | 9/1971 | Madden et al. | 141/59 X |
| 3,719,215 | 3/1973 | Murray | 141/207 |
| 3,911,973 | 10/1975 | Casteline | 141/59 |

*Primary Examiner*—Richard E. Aegerter
*Assistant Examiner*—Frederick R. Schmidt
*Attorney, Agent, or Firm*—F. Travers Burgess

[57] ABSTRACT

A fuel dispensing nozzle has a diaphragm responsive to vacuum for shutting off the flow of fuel through the nozzle, the diaphragm chamber having a vent to atmosphere through a tube extending to the mouth of the nozzle spout and closeable by fuel in the tank being filled to cause vacuum to actuate the diaphragm and shut off the fuel flow through the nozzle, a valve in the vent tube, a piston for closing the vent tube valve in response to vapor pressure in the tank being filled, a vapor return conduit providing vapor communication between the interior of the tank being filled and the fuel source, the vent tube valve piston being exposed to vapor pressure in the vapor return conduit, whereby to shut off the flow of fuel through the nozzle when predetermined vapor pressure occurs in the tank being filled, and additional means holding the vent tube valve closed and closing the vapor return conduit to prevent vapor leakage from the fuel source except when the spout is inserted in the filler inlet of a tank, and operable upon insertion of the spout into a tank to release the vent tube valve and thereby break the vacuum acting on the automatic shut-off valve diaphragm to open the shut-off valve and permit the flow of fuel from the nozzle through the spout into the tank to be filled.

15 Claims, 14 Drawing Figures

AUTOMATIC SHUT-OFF NOZZLE WITH LOCKABLE VAPOR RELIEF VALVE

BACKGROUND OF THE INVENTION

1. Field of the Invention

The invention relates to fuel dispensing nozzles having automatic shut-off means responsive to fuel level, vapor pressure in the tank being filled, and removal of the spout from the tank being filled.

2. The Prior Art

In prior devices for utilizing fuel and vapor pressure in the tank being filled to shut off fuel dispensing nozzles, no means has been provided for keeping the nozzle shut off at all times except when the nozzle spout is inserted in a tank being filled.

SUMMARY OF THE INVENTION

The invention provides a fuel dispensing nozzle of the vacuum actuated automatic shut-off type in which the vent tube leading from the mouth of the nozzle spout to the vacuum chamber includes a valve held closed except when the spout is inserted into the filler inlet of a tank to be filled, and automatically freed to open when the spout is inserted into a tank, and automatically closed responsive to excessive vapor pressure in the tank so as to cause vacuum in the nozzle to actuate the diaphram for shutting off flow of fuel through the nozzle under these conditions.

DETAILED DESCRIPTION OF THE INVENTION

Figure 1:
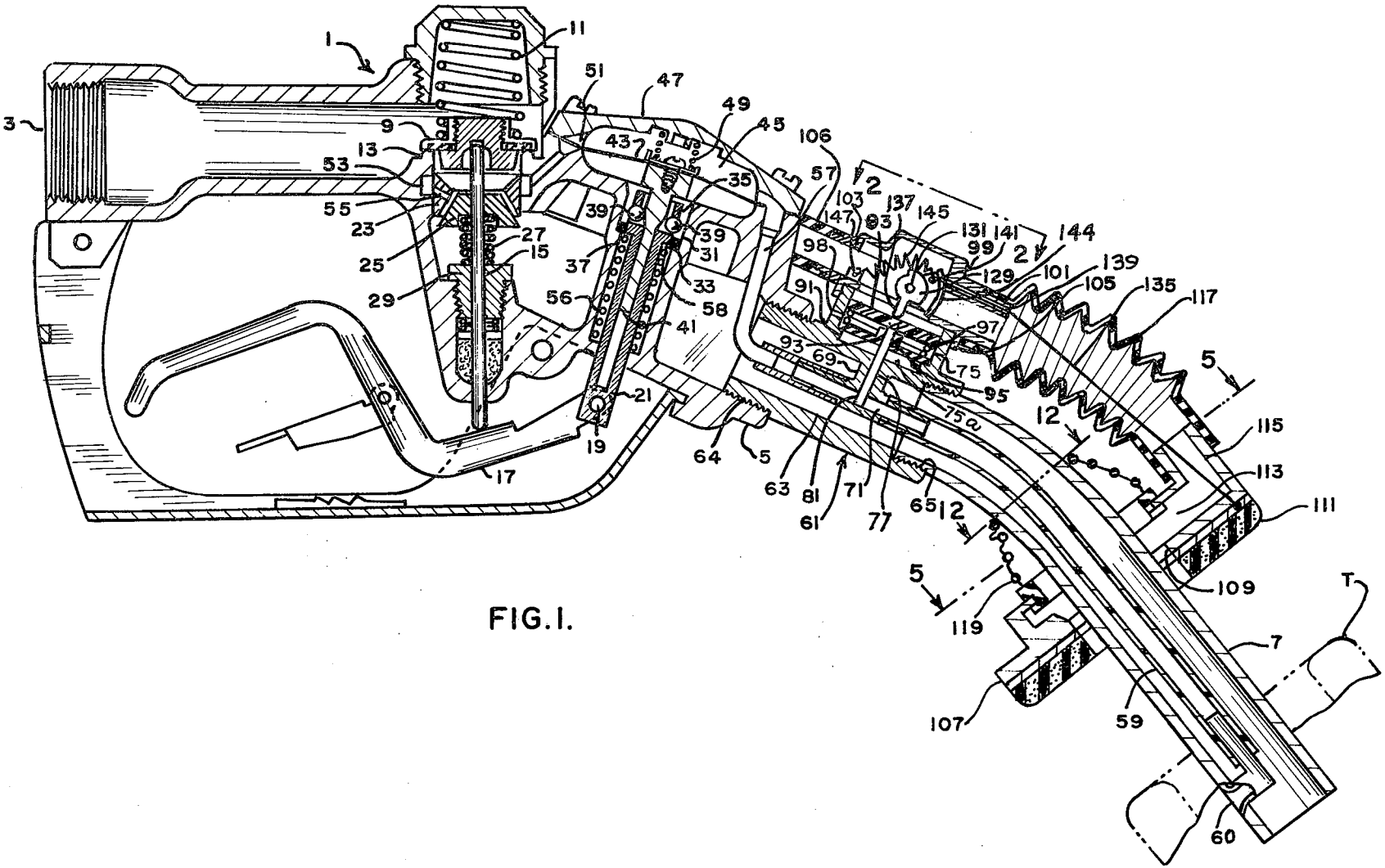
FIG. 1 is a longitudinal vertical sectional view through a nozzle incorporating the invention.
Figure 2:
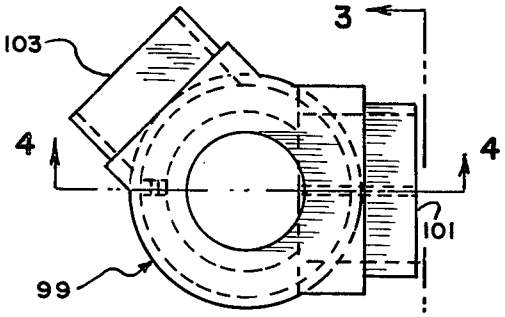
FIG. 2 is a top view of a portion of the nozzle taken from line 2—2 of FIG. 1.
Figure 3:
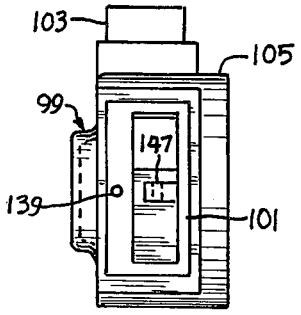
FIG. 3 is an end view of the element shown in FIG. 2 taken from line 3—3 of FIG. 2.
Figure 4:
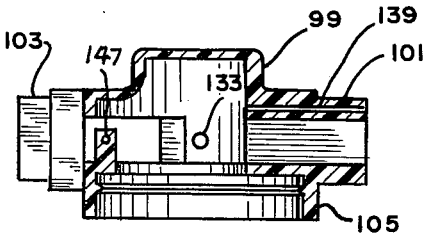
FIG. 4 is a longitudinal vertical sectional view taken along line 4—4 of FIG. 2.
Figure 5:
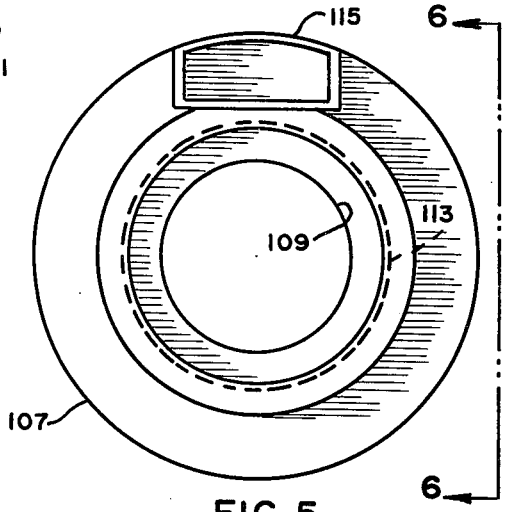
FIG. 5 is a top view of the fuel inlet sealing ring taken from line 5—5 of FIG. 1.
Figure 6:
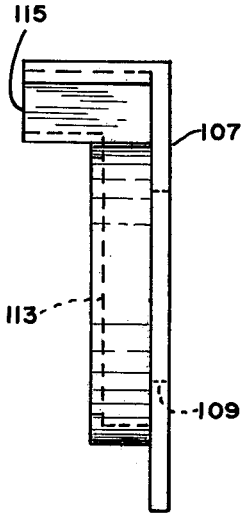
FIG. 6 is a full side elevational view of the sealing ring taken from line 6—6 of FIG. 5.
Figure 7:
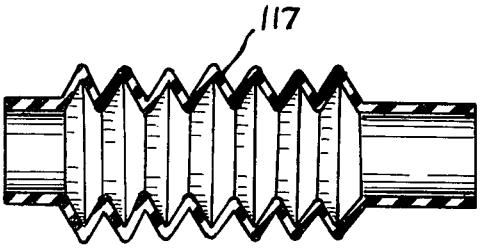
FIG. 7 is a longitudinal vertical sectional view of the vapor tube connected to the sealing ring.
Figure 8:
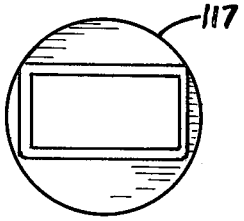
FIG. 8 is an end view of the tube illustrated in FIG. 7.
Figure 9:
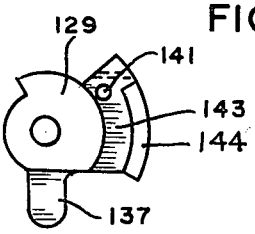
FIG. 9 is a side view of the latch on the vent closure valve.
Figure 10:
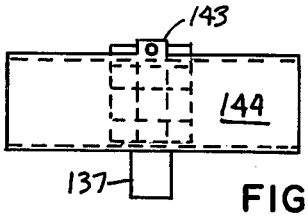
FIG. 10 is an end elevational view of the latch illustrated in FIG. 9.
Figure 11:
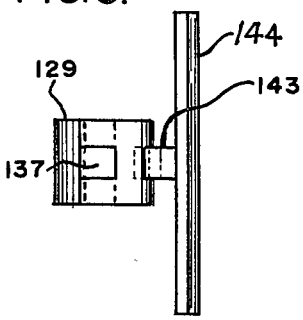
FIG. 11 is a bottom view of the latch of FIGS. 9 and 10.
Figure 12:
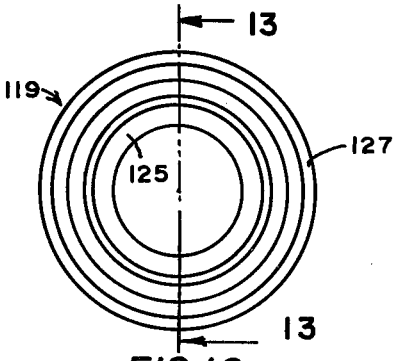
FIG. 12 is a transverse end view of the resilient seal for the sealing ring, taken from line 12—12 of FIG. 1.
Figure 13:
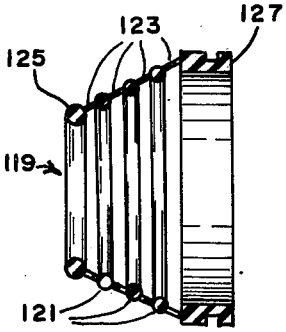
FIG. 13 is a longitudinal vertical sectional view taken along line 13—13 of FIG. 12.

The nozzle includes a body generally indicated at 1 and having an inlet 3 to which a fuel hose is connected, and an outlet 5 communicating with a spout 7 insertible into a tank T to be filled.

Within body 1, between inlet 3 and outlet 5, is a main valve 9, biased by spring 11 into sealing engagement with its seat 13 and thereby preventing passage of fuel from inlet 3 to outlet 5. Valve 9 is secured to the upper end of its stem 15 which slides in body 1 and projects downwardly from valve 9, and an operating lever 17, fulcrumed at 19 on a plunger 21 slidably mounted in body 1, engages the lower end of stem 15 so that upward pressure on lever 17 forces valve 9 upwardly to open position, permitting the flow of fuel past it.

Below valve seat 13 a downwardly facing conical valve seat 23 is mounted in body 1 and a mating frustoconical poppet valve 25 is slidably mounted on stem 15 and biased upwardly into engagement with seat 23 by a spring 27 seated on stem guide sleeve 29.

In order to cause main valve 9 to close automatically under certain conditions a ball latch device comprising an enlarged chamber 31 is formed in body 1 adjacent the upper end of plunger 21 defining a peripheral shoulder 33 and the upper end of plunger 21 is formed with a central axial bore 35 intersected by a transverse bore 37 at the same height as shoulder 33. Balls 39 are normally seated in transverse bore 37 and project outwardly therefrom into engagement with shoulder 33 to prevent downward movement of plunger 21. Balls 39 are normally positioned in this latching position by the thickened upper end portion of latch pin 41 which extends into bore 35 and bears against the balls. Latch pin 41 is secured to a diaphragm 43 mounted in a chamber 45 formed by a cap 47 removably secured to body 1 and a spring 49 seated against cap 47 biases diaphragm 43 and latch pin 41 downwardly into latching engagement with balls 39.

For providing vacuum to chamber 45 to release latch pin 41 a short passage 51 extends from diaphragm chamber 45 to an annular groove 53 in body 1 surrounding poppet valve seat 23 and a radial passageway 55 through the latter connects the neck of seat 23 to annular groove 53.

With the described arrangement, when lever 17 is pressed upwardly to open main valve 9, fulcrum 19 remains stationary because balls 39 prevent downward movement of plunger 21. Pressurized fuel passing valve 9 unseats poppet valve 25 and a venturi effect is formed between poppet valve 25 and its seat 23, creating a vacuum in groove 53, passage 51 and diaphragm chamber 45, which tends to raise the diaphragm against spring 49, and with it, latch pin 41 so that its thinner lower portion permits radial inward movement of balls 39 clear of shoulders 33, and consequent downward movement of plunger 21 to release lever 17 and permit valve stem 15 and with it valve 9 to lower against seat 13 under pressure of spring 11.

Normally diaphragm chamber 45 is vented to atmosphere by a passage 57 in nozzle body 1 which communicates with a vent tube 59 within spout 7, terminating in a port 60 near the mouth of the spout so that, as long as passage 57 and tube 59 are open, the vacuum in chamber 45 will be broken and diaphragm 43 will not release balls 39 to permit downward movement of plunger 21 and consequent automatic closure of main valve 9.

If however, the fuel level in tank T covers vent tube port 60, to block admission of air to tube 59, the vacuum in chamber 45 will cause diaphragm 43 to release balls 39 and thereby cause the closure of main valve 9, preventing further flow of fuel through the nozzle. For returning plunger 21 and lever fulcrum 19 to their normal operating positions, a coil spring 56 is seated at its lower end against body 1 and engages a downwardly facing shoulder 58 on plunger 21.

For making diaphragm 43 responsive to vacuum to shut valve 9 except when the spout is inserted in a tank to be filled, and also when higher than predetermined vapor pressure occurs in tank T, a self-contained valve unit generally indicated at 61 is interposed between nozzle body outlet 5 and spout 7. Unit 61 comprises a tubular passageway portion 63 having external threads 64 at one end for securement to body outlet 5 and internal threads 65 at its other end for attachment of spout 7.

Radial struts 69 support a central tubular element 71 in tubular passageway portion 63, for connection, at its opposite ends, to body passage 57 and vent tube 59, so as to provide a continuous vent passage from diaphragm chamber 45 to port 60.

At its top unit 61 is formed with a hollow circular boss defining a circular chamber 75 normal to the axis of tubular passage 63, and a cylindrical bore 77, through a radial strut 69, connects chamber 75 with the hollow interior of tubular element 71. A gate valve 81 is slidably mounted in bore 77 and is formed with a disc-shaped piston 83 on its outer end, slidably received in circular chamber 75. Near its inner end, chamber 75 is formed with an annular shoulder 91 against which a sealing disc 93 of elastomeric material is seated, disc 93 being centrally apertured at 95 to permit the passage therethrough of valve 81. A coil spring 97 seated against sealing disc 93 biases piston 83 outwardly to urge valve 81 toward open position, clear of the passage through tubular element 71. To prevent vacuum conditions in passageway 57, 71 from passing through bore 77 and there causing piston 85 to move downwardly and close valve chamber 81, a small atmospheric vent opening 98 is formed in the wall of chamber 75. Sealing disc 93 cooperates with underlying chamber 75*a* to prevent laminar flow of air from atmospheric vent 98 to passageway 71 and consequent undesired reduction in vacuum in passages 71 and 57 and in diaphragm chamber 45.

A cap 99 including inlet and outlet nipples 101 and 103 of rectangular cross section is formed with a depending annular flange 105 sealingly engageable with the upper end of chamber 75 mounted thereon, nipples 101 and 103 communicating with the hollow interior of cap 99 and through it with chamber 75 above valve piston disc 83 so that the latter will be responsive, to the extent described below, to vapor pressure conditions within cap 99. A vapor return line 106 provides a connection between nipple 103 and the fuel source which may be the usual underground tank (not shown) for returning vapor from tank T to the underground tank. For transmitting vapor from tank T to cap 99 and through it to vapor return line 106, a sealing ring 107 having a central aperture 109 is positioned about spout 7 and is faced with a pad 111 of soft resilient elastomeric material adapted for sealing engagement with the filler portion of tank T, central aperture 109 for sealing disc 107 being somewhat larger than the outer diameter of spout 7 to provide an annular opening therebetween. An annular groove 113 connects aperture 109 to a nipple 115 of generally rectangular cross section elongated tangentially with respect to sealing disc 107, and nipple 115 is connected by means of a corrugated bellows-like tube 117 to inlet nipple 101 of vent valve cap 99.

A combined seal and spring unit 119 of generally hollow frusto-conical shape is secured at its large end to sealing ring 107 and at its small end surrounds and resiliently sealingly grips spout 7 intermediate sealing ring 107 and valve unit 61. Combined seal and spring unit 119 is molded from elastomeric material and has a number of spaced annular ribs 121 connected by frusto-conical web portions 123 so as to yieldably resist distortion and thereby bias sealing disc 107 toward the outer end of the spout. Because of the tight sealing engagement between its end annular bead 125 and spout 7 and its large end annular ring 127 and small end sealing disc 107, it also provides an effective seal against the passage of vapor or liquids. From the foregoing it will be seen that any vapor emitted from tank T through central aperture 109 in sealing disc 107 and passing through annular groove 113 into nipple 115 will pass through corrugated tube 117 and into valve unit cap 99 where its pressure will act on piston disc 83 in opposition to spring 97, and if in excess of a predetermined value will force valve 81 downwardly, closing vent passage 57, 59 from the spout mouth region to shut off diaphragm vacuum chamber 45, thus permitting vacuum therein to release plunger 21 and close main valve 9 to shut off the flow of fuel through the nozzle.

In order to maintain valve 81 in closed position, and to prevent passage of vapor through line 106 from the underground tank or other fuel source and consequent vapor leakage from the fuel source, at all times except when the spout is fully inserted in the filler inlet of a tank T, a combined latch and valve member 129 is pivotally mounted on a pin 131 seated in hole 133 in vent valve cap 99 and is connected by a wire 135 to sealing ring 107 so that when sealing ring 107 is in the position shown in FIG. 1, radial finger 137 of latch member 129 will be aligned with valve member 81 which it will hold in closed position blocking passageway 71. A radial rib 143 on member 129 mounts a valve closure element 144 in the form of an arc of a cylinder which seats against the inner end of nipple 101 to close the passage therethrough and prevent the leakage of vapor from the fuel source when the parts are in the position shown in FIG. 1. Wire 135 passes through corrugated tube 117 and through a passage 139 in nipple 101 and the adjacent portion of vent valve cap 99 to its connection to radial rib 143 on combined latch and valve member 129. For causing disengagement of latch finger 137 with vent valve piston 83 when tension is released on wire 135 and opening valve element 144, a tension coil spring 145 is secured at one end to hole 141 in latch 129 and extends in a counterclockwise direction therefrom to a point of securement at 147 to the interior of cap member 99.

Figure 14:
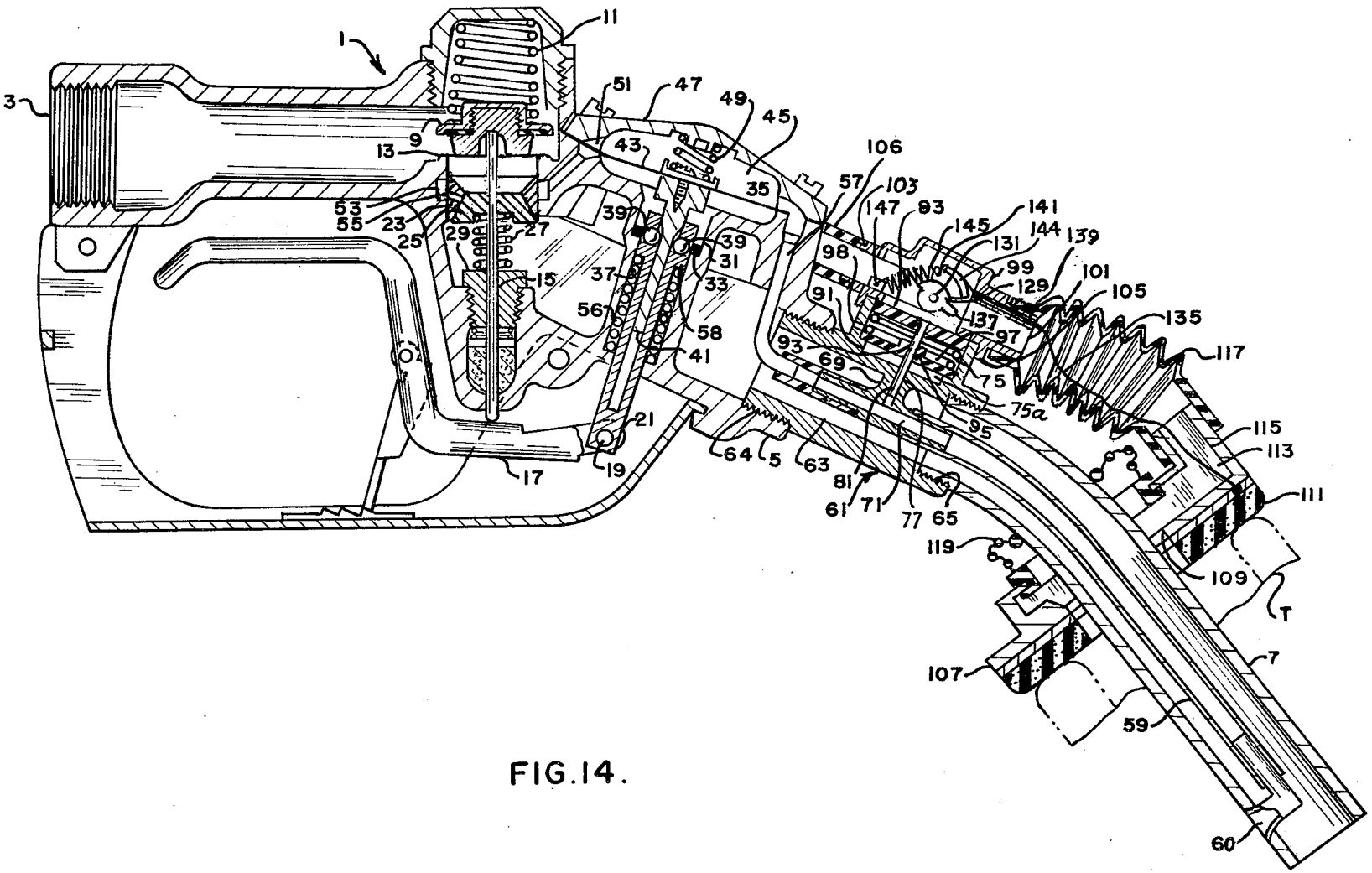
FIG. 14 is a longitudinal vertical sectional view corresponding to FIG. 1, but showing the condition of the nozzle when the spout is fully inserted in a tank.

With the structure as described above, when spout 7 is inserted into the filler neck of tank T, as shown in FIG. 14, with resilient surface 111 of sealing ring 107 in tight sealing engagement therewith, so as to compress combined spring and seal unit 119 and also relieve tension on wire 135, spring 145 will rotate latch 129 in a counterclockwise direction, opening valve closure element 144 in the vapor return line and moving finger 137 out of alignment with valve 81 and permitting spring 97 to urge piston 85 upwardly so as to cause valve 81 to open passageway 71, thereby admitting air through vent passage 59, 71, 57 to diaphragm vacuum chamber 45 and breaking the vacuum therein so as to permit opening of main valve 9 by actuation of lever 17.

In the event that vapor pressure in tank T exceeds a predetermined value, as vapor from the tank passes through annular groove 113, nipple 115, corrugated tube 117 and nipple 101 into vent valve cap 99, its pressure will act on piston 83 in opposition to spring 97 to force valve 81 downwardly, blocking passage 71 and thereby permitting vacuum in vacuum chamber 45 to cause the closure of main nozzle valve 9. In the event, of course, the fuel level in the tank rises above port 60 near the spout mouth, the vent passage will be similarly blocked and vacuum in chamber 45 will similarly shut off valve 9.

In the event vapor pressure decreases below the predetermined value, spring 97 will urge valve piston 83 upwardly and thereby cause vent valve 81 to clear the vent passage, breaking the vacuum in chamber 45 and permitting main valve 9 to open.

Upon removal of the spout from the tank filler neck, combined seal and spring unit 119 will push sealing ring 107 outwardly along the spout, applying tension to wire 135, which will overcome the tension of spring 145 and rotate combined latch and valve member 129 in a clockwise direction until its finger 137 forces vent valve piston 83 downwardly causing vent valve 81 to vent passageway 71, and closure element 144 blocks the vapor return line 106, whereby vacuum in vacuum chamber 45 causes valve 9 to shut and prevent further flow of fuel through the nozzle, and leakage of vapor from the fuel source through vapor return line 106 is prevented.

The details of the structure may be varied substantially without departing from the spirit of the invention and the exclusive use of such modifications as come within the scope of the appended claims is contemplated.

We claim:

1. In a liquid dispensing nozzle, a body having a inlet, an outlet and liquid passage means therebetween including a main valve controlling the flow of liquid from said inlet to said outlet, a spring biasing said main valve closed, a spout fixedly connected to said outlet and adapted for insertion in the inlet opening of a tank, manually actuated means for opening said main valve in opposition to said spring, Venturi means in said fuel passage means including a vacuum take-off, a vacuum chamber, means connecting said vacuum take-off to said vacuum chamber, means responsive to vacuum within said chamber caused by the flow of liquid through said Venturi means operatively connected to said manually actuated means for releasing the same and thereby permitting said spring to close said main valve, vent passage means communicating with said vacuum chamber to render said vacuum-responsive means inoperative when said vent passage means is open and having a port insertible in the tank with said spout, a normally open vent control valve in said vent passage means between said port and said vaccum chamber, vapor conduit means adapted for sealed communication with the tank inlet opening, a pressure responsive element exposed directly to pressure in said vapor conduit means and arranged to close said vent control valve when vapor pressure in the tank and said vapor conduit exceeds a predetermined value whereby said vacuum-responsive means becomes operable to release said manually operated means and thereby permits said spring to close said main valve, and latch means engaging said pressure-responsive element to hold said vent control valve closed except when said spout is inserted in a tank and releasing the same to open responsive to full insertion of said spout in a tank, whereby to maintain vacuum in said chamber and prevent opening of said main valve except when said spout is inserted in a tank and to break the vacuum in said chamber and thereby permit said main valve to be opened while said spout is inserted in a tank.

2. In a liquid dispensing nozzle according to claim 1, said latch means comprising a latch having a valve latching position closing said vent control valve spring means biasing said latch out of valve latching position, an element carried on said spout and adapted for engagement with the inlet of a tank when the spout is inserted therein, means resiliently biasing said spout-carried element toward the mouth of said spout, and linkage means operatively connecting said latch and said spout-carried element and opposing said spring means to maintain said latch in valve-latching position except while said spout is inserted in a tank, and for permitting said spring means to release said latch responsive to movement of said spout-carried element away from the mouth of said spout when said spout-carried element engages the tank inlet upon insertion of said spout, whereby to permit said vent control valve to open and thereby cause said vacuum responsive means to permit said main valve to be opened upon insertion of the spout in a tank.

3. In a liquid dispensing nozzle according to claim 2, means resiliently biasing said vent control valve toward open position in opposition to said latch.

4. In a liquid dispensing nozzle according to claim 3, said latch being pivotally mounted with reference to said vent control valve on an axis parallel to the surface of said pressure-responsive element and having a surface engageable with said pressure-responsive element to hold said vent control valve closed, tension means connecting said latch to said spout-carried element and holding said latch in engagement with said pressure-responsive element responsive to expansion of said resilient means biasing said spout-carried element toward the mouth of said spout, said latch being releasable responsive to relaxation of said tension means when said spout-carried element engages the inlet of a tank.

5. In a liquid dispensing nozzle according to claim 3, said spout-carried element comprising an annular member having a resilient face sealingly engageable with a tank inlet.

6. In a liquid dispensing nozzle according to claim 5, said annular member having a central opening larger than the cross section of said spout, said resilient biasing means being sealingly secured to said annular member on the side thereof remote from said resilient face and being sealingly secured at its other end to said spout, said vapor conduit means communicating with said central opening in said annular member to receive vapor therethrough from the tank.

7. In a liquid dispensing nozzle according to claim 3, said vacuum chamber and vacuum responsive means being located within said nozzle body, said vent passage means having a portion within said body and a separate portion within said spout, said vent control valve being positioned between said body and said spout.

8. In a liquid dispensing nozzle according to claim 7, a valve unit containing said vent control valve and forming the connection between said body outlet and said spout.

9. In a liquid dispensing nozzle according to claim 8, said valve unit comprising a tubular passage portion aligned with said body outlet and said spout, a central tubular element connected to said body and spout portions of said vent passage, said vent control valve being slidably mounted in said unit in a direction transverse thereof.

10. In a liquid dispensing nozzle according to claim 9, said vent control valve having a piston exposed to vapor pressure conditions in said conduit means and said valve unit including a chamber normal to the axis of said tubular passage portion and slidably receiving said piston.

11. In a liquid dispensing nozzle according to claim 10, a spring seated in said piston chamber and biasing said piston outwardly to maintain said vent control valve in open condition.

12. In a liquid dispensing nozzle according to claim 1, said vapor conduit being adapted for connection to the source of liquid dispensed by the nozzle for the return thereto of vapor from the tank, a closure element in said vapor conduit operable with said latch means to close said vapor conduit except when said spout is inserted in a tank and to open said vapor conduit while said spout is inserted in a tank.

13. In a liquid dispensing nozzle according to claim 12, said latch means comprising a latch, said closure element being mounted on said latch, spring means biasing said latch out of valve-latching position, closing said vent control valve an element carried on said spout and adapted for engagement with the inlet of a tank when the spout is inserted therein, means resiliently biasing said spout-carried element toward the mouth of said spout, and linkage means operatively connecting said latch and said spout-carried element and opposing said spring means to maintain said latch in valve-latching position and said closure element in closed position closing said vapor return conduit except while said spout is inserted in a tank, and for permitting said spring means to release said latch and opening said closure element responsive to movement of said spout-carried element away from the mouth of said spout when said spout-carried element engages the tank inlet upon insertion of said spout, whereby to permit said vent passage valve to open and to open said closure element in said vapor return conduit.

14. In a liquid dispensing nozzle according to claim 13, means resiliently biasing said vent control valve toward open position in opposition to said latch.

15. In a liquid dispensing nozzle according to claim 14, said vent control valve having a piston exposed to vapor pressure conditions in said vapor return conduit and arranged to close said vent control valve when vapor pressure within the tank and in said vapor return conduit exceeds a predetermined value, whereby said vacuum operated means becomes operable to release said manually operated means and thereby cause the closure of said main valve, said latch being engageable with said piston to hold said vent control valve closed and disengageable therefrom to release said vent control valve.

* * * * *